United States Patent [19]

Sopori et al.

[11] Patent Number: 4,463,927

[45] Date of Patent: Aug. 7, 1984

[54] APPARATUS FOR SECTIONING DEMOUNTABLE SEMICONDUCTOR SAMPLES

[75] Inventors: Bhushan L. Sopori, Scottsdale; Abraham Wolf, Sun City West, both of Ariz.

[73] Assignee: The United States of America as represented by the United States Department of Energy, Washington, D.C.

[21] Appl. No.: 469,350

[22] Filed: Feb. 24, 1983

[51] Int. Cl.[3] ..... B24B 41/06; B22D 19/04; B25B 11/00

[52] U.S. Cl. ..... 249/95; 33/169 B; 51/216 P; 51/217 P; 51/221 R; 51/277; 249/62; 249/105; 269/7

[58] Field of Search ..... 249/62, 95, 105; 51/216 P, 217 P, 217 R, 221 R, 277; 269/7; 33/168 R, 169 B

[56] References Cited

U.S. PATENT DOCUMENTS

| | | | |
|---|---|---|---|
| 1,368,797 | 2/1921 | Heck | 269/7 |
| 1,389,912 | 9/1921 | Stead | 51/277 |
| 2,942,568 | 6/1960 | Hamilton et al. | 249/95 |
| 3,723,006 | 3/1973 | Thomas, Jr. | 269/21 |
| 3,888,053 | 6/1975 | White et al. | 51/277 |
| 3,916,511 | 11/1975 | Brehe | 249/62 |
| 4,316,757 | 2/1982 | Walsh | 51/277 |

OTHER PUBLICATIONS

"Damage-Free Polishing of Polycrystalline Silicon", Sopori et al., J. Electrochemical Society, vol. 128, No. 1, Jan. 81, pp. 215-218.

*Primary Examiner*—James B. Lowe

*Attorney, Agent, or Firm*—Bruce R. Mansfield; Paul A. Gottlieb; Michael F. Esposito

[57] ABSTRACT

Apparatus for use during polishing and sectioning operations of a ribbon sample is described. The sample holder includes a cylinder having an axially extending sample cavity terminated in a first funnel-shaped opening and a second slot-like opening. A spring-loaded pressure plunger is located adjacent the second opening of the sample cavity for frictional engagement of the sample prior to introduction of a molding medium in the sample cavity. A heat softenable molding medium is inserted in the funnel-shaped opening, to surround the sample. After polishing, the heater is energized to allow draining of the molding medium from the sample cavity. During manual polishing, the second end of the sample holder is inserted in a support ring which provides mechanical support as well as alignment of the sample holder during polishing. A gauge block for measuring the protrusion of a sample beyond the second wall of the holder is also disclosed.

14 Claims, 5 Drawing Figures

APPARATUS FOR SECTIONING DEMOUNTABLE SEMICONDUCTOR SAMPLES

CONTRACTUAL ORIGIN OF THE INVENTION

The United States Government has rights in this invention pursuant to Subcontract No. XS-0-9234 with Motorola, Inc. under Contract No. EC-77-C-01-4042 between the U.S. Department of Energy and Solar Energy Research Institute.

BACKGROUND OF THE INVENTION

This invention relates to apparatus for sectioning demountable semiconductor samples, particularly thin-edged crystal ribbon samples.

The need for sectioning or edge-polishing extremely thin semiconductor samples and the like has become increasingly important in modern technology applications. The need for such polishing arises since semiconductor wafers which are either sawn or mechanically polished, possess surface stresses (damage) which must be removed prior to semiconductor device fabrication. The extent of damage to the semiconductor's surface depends on the type of saw (e.g. whether the saw is of the wheel or the wire type) and the polishing conditions (e.g. grit material, bit size, and pad material). At times, the depth of the damaged region requires extensive working of the damaged surface, thereby subjecting the crystal sample to protracted periods of mechanical stresses.

Polycrystalline silicon solar cell devices require damage-free polishing in their fabrication. Although cells of about ten percent efficiency can be fabricated on conventionally prepared polycrystalline silicon substrates, it is expected that higher efficiencies can be obtained if performance-limiting grain-boundary effects are better understood and thereby rendered subject to moderation. Much of the investigative work to study photovoltaic mechanisms at grain boundaries involves electro-optical techniques. For this purpose, it is necessary to polish the surface of a polycrystalline silicon sample such that surface damage and profile variations, particularly those occurring at the grain boundaries, is minimized.

Several problems associated with conventional processing of polycrystalline silicon will be described briefly. Chemical and (fine grit) mechanical polishing techniques are known to result in steps at the grain boundaries due to different removal rates for various grain orientations, thereby subjecting the sample to a certain amount of defect structure. Also, mechanical polishing inherently causes surface damage and resultant high surface recombination velocity which degrades solar cell performance and complicates the interpretation of measurement data. Further, chemical polishing/etching usually causes "grooving" at the grain boundaries since the etch rate at grain boundaries is often higher than that of the grains themselves.

Analysis of defect and grain structure in semiconductor samples often involves sectioning a thin semiconductor sample. Typically, a desirable sectioning of a thin sample would allow convenient sample demounting, would provide damage-free polishing, and would eliminate chipping of the edge under investigation, i.e. the sectioning would provide excellent edge quality. A commonly used procedure for sectioning semiconductor samples consists of mounting the sample in epoxy, followed by lapping and grit polishing. Several variations in sample mounting and polishing are currently in use, depending on the types of semiconductor and polishing materials, and the nature of the analysis to be carried out. For example, several different types of epoxies are available which possess different degrees of chemical inertness relative to the sample. This presents the possibility of chemically softening the cured epoxy for sample demounting, but also gives rise to the possibility of chemical reaction of the sample. These difficulties are more fully explained in the article by B. L. Sopori, inventor of the present invention, T. Nilsson, and M. McClure, 128, Journal of the Electrochemical Society, 215 (1981).

Conventional sectioning procedures present several difficulties which will now be considered. Mechanical polishing leaves on the surface of the sample a residual damage which may interfere with structural details revealed by defect etching. Grit polishing results in poor edge quality in which chipping of the sectioned edge is frequently unacceptable. While chemical/mechanical polishing might be looked to as a successful alternative to remove the surface damage, such techniques might not be compatible with the epoxy molding method of mounting since even a small amount of dissolved epoxy which is spread over a sectioning surface will cause nonuniform etching. Further, large samples such as those of the polycrystalline type, crack under the stresses imparted to the sample during curing of the epoxy mounting material. Also, chemical solutions used for softening the cured epoxy mounting medium may react with the sample, thereby destroying the edge surface.

It is therefore an object of the present invention to provide an apparatus for sectioning thin samples, wherein the sample is easily demounted after polishing.

It is another object of the present invention to provide a sectioning apparatus which results in a damage-free polished product.

It is yet another object of the present invention to provide an apparatus for sectioning which eliminates chipping of the polished edge.

It is a further object of the present invention to provide an apparatus for sectioning of large samples, such as those of polycrystalline type, which eliminates stresses, particularly torsional stresses applied to the sample during mounting and demounting, as well as the polishing process itself.

It is another object of the present invention to provide an apparatus for sectioning of samples which avoids the use of chemical solutions, thereby eliminating any possible chemical reaction with the sample.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

These and another objects of the present invention are provided by a cylindrical sample holder having an axially extending sample cavity of rectangular cross-sectional configuration. A first end of the cavity is terminated in a funnel-shaped opening, and a second opposing end of the cavity is terminated in a slotted opening. A pressure plunger and an array of pressure pads are arranged on opposing sides of the sample cavity, adjacent the second, slotted end of the holder. A crystalline or other ribbon-like sample to be sectioned is inserted in the funnel-shaped opening of the sample cavity, and advanced so as to lie between the retracted pressure plunger and the pressure pad array. The pressure plunger is then released so as to engage and hold the sample in a fixed position by means of friction between the sample and pressure pad/pressure plunger surfaces.

The sample holder includes an axially-extending heating element which facilitates the introduction of paraffin wax, glycol pathalate or other releasable, chemically inert molding medium into the funnel end of the sample cavity. After the molding medium is inserted in the sample cavity, the heater is de-energized and the molding medium is allowed to stiffen. At this point, the sample is ready for insertion in a reciprocating arm of a polishing machine. Alternatively, if the sample is to be hand polished, the slotted end of the holder is inserted into a polishing ring which aligns the sample relative to the polishing surface.

BRIEF DESCRIPTION OF THE DRAWINGS

In the Figures, where like elements are referenced alike.

DETAILED DESCRIPTION OF THE PREFERRED EMBODIMENT

Figure 1:
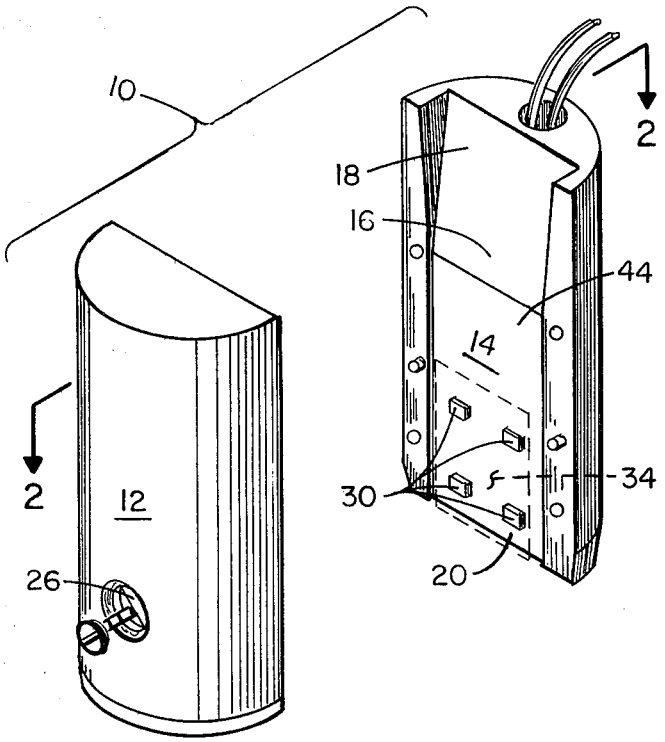
FIG. 1 is an exploded perspective view of the sample holder according to the invention.
Figure 2:
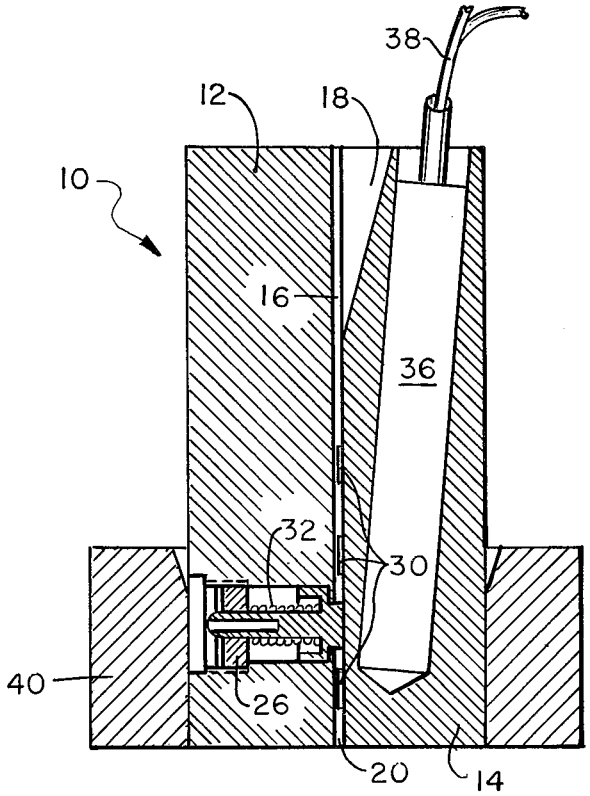
FIG. 2 is a cross-section elevational view taken along the line 2—2 of FIG. 1, shown in combination with a supporting ring.

Referring now to the drawings, in an particular to FIGS. 1 and 2, a sample holder 10 is shown conveniently formed of two mating half-sections 12 and 14. Sample holder 10 contains an axially extending, elongated sample cavity 16 of rectangular cross-section for receiving crystalline or other ribbon-like samples to be sectioned or polished. Cavity 16 has a first funnel-shaped end 18 and a second slotted end 20. The ribbon-like sample to be polished, designated by the numeral 34, is inserted in funnel-shaped end 18 and advanced along cavity 16 toward slotted end 20. Plunger 26 and an array of pressure pads 30 are arranged on opposing sides of sample cavity 16, adjacent slotted end 20. Pressure plunger 26 is biased for movement toward the array of pressure pads 30 by a spring member 32. During insertion of the sample in holder 10, pressure plunger 26 is retracted until the sample is advanced a predetermined distance along cavity 16, so that the forward end thereof is aligned adjacent slotted end 20. Thereafter, the pressure plunger is released so that the bias force of spring 32 maintains the engagement between the sample and plunger 26, as well as the array of pressure pads 30.

The molding medium employed for use with the invention is preferably heat softenable to allow easy damage-free removal of the sample upon completion of the polishing operation. Accordingly, sample holder 10 includes an axially-extending rod-like heater element 36 which heats the walls of sample holder 10 immediately adjacent the sample cavity. Heater 36 is preferably of the electrical type and includes leads 38 for connection to an external source of electrical energy. After the sample is inserted, aligned and retained within sample cavity 16, holder 10 is maintained in a vertical direction while a releasable, chemically inert molding medium such as paraffin wax, glycol pathalate, or the like, is inserted in funnel-shaped end 18. Maintained in a fluid condition by heater 36, the molding medium flows along sample cavity 16 so as to surround the sample 34, particularly portions of the sample adjacent slotted end 20. When molten wax begins to drip from the lower end 20, holder 10 is rotated to assume a horizontal direction, allowing a meniscus to form in the molten wax. Cavity 16 is accurately dimensioned, relative to the size of sample 34, to facilitate the capillary forces necessary to form the meniscus. This feature of the invention conveniently provides a molding medium immediately adjacent the edge to be sectioned, while avoiding interference of the molding medium with the sectioning process.

After the polishing operation is completed, the viscosity of the chemically inert paraffin wax is conveniently altered in a stressless manner during sample extraction so that the molten wax continuously cushions the sample as it emerges from the sample holder. With holder 10 maintained in a vertical direction, plunger 26 is retracted, and heater element 36 is energized. Due to the accurate dimensioning of cavity 16, the viscosity of the softened molding medium, and the rate of heating, sample 34 remains encapsulated or surrounded in molten wax as it slides down cavity 16, emerging at slotted end 20.

When installed in an automatic polishing device, sample holder 10 provides the required mechanical stability and alignment of the sample to be sectioned or polished. If however, the sample is to be hand polished, a support ring or collar 40 such as that shown in FIG. 2 may be employed to provide the required alignment of the contained sample, relative to the polishing surface.

Figure 3:
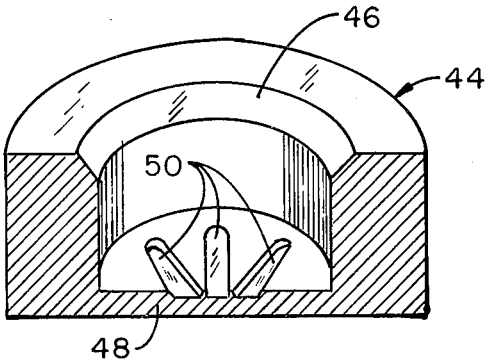
FIG. 3 is a cross-sectional view of a gauge block used in conjunction with the sample holder of FIGS. 1 and 2.
Figure 4:
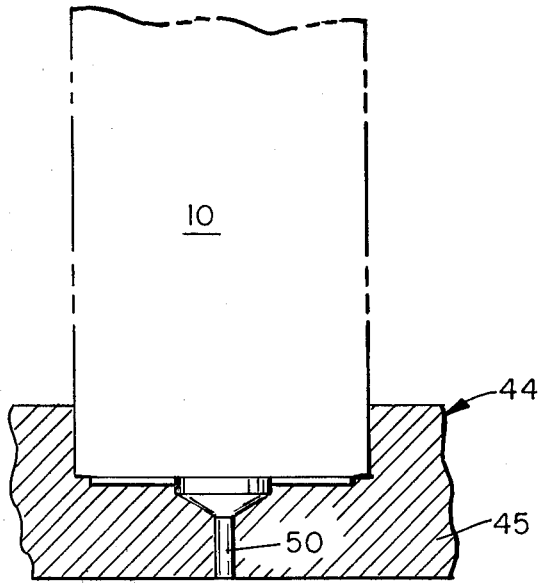
FIG. 4 is a partial cross-sectional view of the sample holder of FIGS. 1 and 2 and the gauge block of FIG. 3, combined together for a polishing operation.

Referring now to FIGS. 3 and 4, gauge block 44 provides precise axial alignment of a sample within cavity 16. Gauge block 44 comprises a support ring 46 and an end wall 48 in which accurately dimensioned gauges or depressions 50 are formed. Depressions 50 allow a predetermined advancement of a sample to be polished, beyond the lower surface of holder 10. Alternatively, the thickness of the entire end wall 48 of gauge 44 may be accurately machined so as to cause a predetermined protrusion of the ribbon-like sample.

When utilizing the arrangement of FIG. 4, the sample is first inserted in holder 10, which in turn is inserted in gauge block 44. Plunger 26 is released so as to allow the advancement of the sample into depressions 50 so as to protrude beyond holder 10, allowing polishing or sectioning of the exposed sample end. Holder 10 is then removed from the gauge block and prepared for a polishing or sectioning operation.

Figure 5:
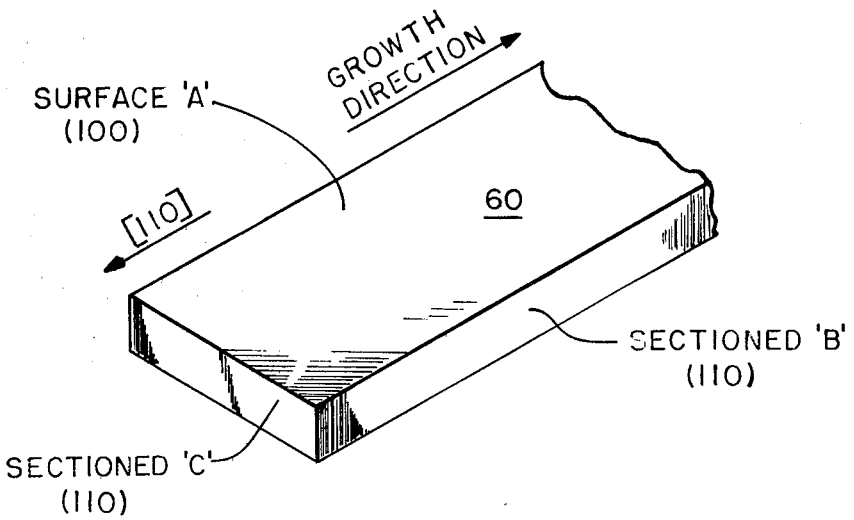
FIG. 5 is a perspective view of a ribbon sample of the type used with the present invention.

In addition to allowing ease of sample mounting and demounting without any appreciable risk of breakage, the arrangement of the present invention allows sectioning of the same sample in different directions, a feature that is very useful in the defect characterization of crystalline samples. Referring now to FIG. 5, multiple sectioning of a crystalline ribbon sample 60 is easily accomplished with two different sized embodiments of the present invention. That is, a second sample holder must be provided to accommodate the length of sample 60, that dimension lying in the direction of crystal growth. Sample 60 has sectioned planes B, C which are, respectively, parallel and perpendicular to the direction of growth of the ribbon 60. Both sectioned surfaces B and C are normal to the reference surface A. In one sample that was studied, dislocation configurations were not evident in plane A, but dislocations of the slip-type, (parallel to the (111) planes along the [110] direction), corresponding to sectioned surfaces B and C, were evident. The sectioning method according to the invention allows clear observation of the fact that more dislocations occur along the growth direction as compared to to those normal to the growth direction. The arrangement of of the present invention affords a high degree of edge preservation, which is necessary for optical examination of dislocation pits occuring on the sectioned edges. Using the arrangement of the present invention, long fragile edges can be successfully sectioned. For example, polycrystalline sample 60 of dimensions $\frac{1}{2}$cm$\times\frac{1}{2}$cm$\times$3 inches was polished on the 3-inch long edges using the apparatus of the present invention.

The embodiments of the invention in which an exclusive property or privilege is claimed are defined as follows:

1. An apparatus for securing and aligning a ribbon-like sample during polishing, comprising:

a hollow body portion having an elongated sample cavity disposed therein, said cavity terminating in end sections which communicate with outside surfaces of said body portion;

said body portion defining a first opening at a first end of said sample cavity;

said body portion defining a second opening adjacent said second end of said sample cavity;

sample engaging means located adjacent said second end of said sample cavity for releasably engaging said sample;

directing means formed in said body portion and located adjacent said first end of said sample cavity for directing a chemically inert, selectively softenable molding medium to portions of said sample cavity adjacent said second end thereof; and softening means in contact with said body portion for selectively softening said molding medium after a polishing operation whereby said molding medium is drained from said sample cavity.

2. The arrangement of claim 1 wherein said body portion comprises a cylinder having an axially extending sample cavity of a substantially rectangular cross-section configuration.

3. The arrangement of claim 2 wherein said softening means comprises an elongated heating element substantially coextensive with said sample cavity.

4. The arrangement of claim 2 wherein said sample engaging means comprises an array of pressure pads located adjacent said second end of said sample cavity on a first side wall of said sample cavity, said sample engaging means further comprising a plunger mounted on a second opposing side wall of said sample cavity, said plunger having a friction pad biased for movement toward said array of pressure pads, said plunger retractable during insertion of a sample between said plunger and said array of pressure pads, and releasable after positioning of a sample in said sample cavity so as to hold said sample captive in a fixed position.

5. The arrangement of claim 2 further including a support ring disposed about said body portion adjacent said second end of said sample cavity.

6. The arrangement of claim 2 further including a gauge block for receiving said second end of said body portion, said gauge block having an end wall of predetermined thickness, with slot means of predetermined depth formed therein, said slot means communicating with said sample cavity.

7. The apparatus of claim 1 further including encapsulating means for continuously encapsulating said sample in said molding medium as said sample is extracted from said apparatus.

8. The arrangement of claim 7 wherein said encapsulating means comprises a predeterminedly dimensioned sample cavity that forms a mold for said selectively softenable molding medium, and means for softening said molding medium to a predetermined viscosity level so that said molding medium remains trapped between said sample and said body portion as said sample is extracted from said apparatus.

9. The arrangement of claim 8 wherein said selectively softenable molding medium softens and hardens in response to being heated and cooled.

10. The arrangement of claim 9 wherein said molding medium comprises paraffin wax.

11. The arrangement of claim 9 wherein said molding medium comprises glycol pathalate.

12. The arrangement of claim 8 wherein said directing means comprises a funnel-shaped means formed in said first end of said sample cavity, a sample cavity which is predeterminedly dimensioned so as to cause wicking of said molding medium toward said second end of said holder, and fluid maintaining means for maintaining said molding medium in a fluid condition as said molding medium is advanced between first and second ends of said holder.

13. The arrangement of claim 12 wherein said maintaining means comprises an electric heater in heat conducting relationship with portions of said body surrounding said sample cavity.

14. The arrangement of claim 13 wherein said body portion is comprised of longitudinally-directed first and second thermally conductive mating body portions each communicating with said sample cavity, and said electric heater is contained in one of said first and said second mating body portions.

* * * * *